United States Patent [19]

Wainwright

[11] 4,402,277

[45] Sep. 6, 1983

[54] AEROFOIL SAIL

[76] Inventor: Barry Wainwright, Help Cottage, Dundry, Bristol BS18 8JF, England

[21] Appl. No.: 321,057

[22] Filed: Nov. 13, 1981

[30] Foreign Application Priority Data

Nov. 21, 1980 [GB] United Kingdom ..... 8037393
Jul. 8, 1981 [GB] United Kingdom ..... 8121130

[51] Int. Cl.[3] ..... B63H 9/04
[52] U.S. Cl. ..... 114/103; 244/214
[58] Field of Search ..... 114/39, 43, 102, 103; 244/214, 215, 219

[56] References Cited

U.S. PATENT DOCUMENTS

| | | | |
|---|---|---|---|
| 3,524,610 | 8/1970 | Alvarez-Calderon | 244/214 |
| 3,904,152 | 9/1975 | Hill | 244/214 |
| 3,934,533 | 1/1976 | Wainwright | 114/39 |
| 3,977,348 | 8/1976 | Bordat et al. | 244/214 |
| 4,096,817 | 6/1978 | Bordat | 244/219 |
| 4,146,200 | 3/1979 | Borzachillo | 244/215 |
| 4,189,120 | 2/1980 | Wane | 244/219 |
| 4,335,671 | 6/1982 | Warner et al. | 244/215 |

FOREIGN PATENT DOCUMENTS

| | | | |
|---|---|---|---|
| 474065 | 1/1936 | United Kingdom | 244/214 |
| 612193 | 11/1948 | United Kingdom | 114/102 |
| 1406240 | 9/1975 | United Kingdom | 244/219 |
| 1492030 | 11/1977 | United Kingdom | 114/103 |

OTHER PUBLICATIONS

Basic Principles of Aero-Hydrodynamics, p. 308.
Scherer, J. O., "Aerodynamics of High-Performance Wingsails", *Marine Technology,* Jul. 1974.

*Primary Examiner*—Trygve M. Blix
*Assistant Examiner*—Jesus D. Sotelo
*Attorney, Agent, or Firm*—Cushman, Darby & Cushman

[57] ABSTRACT

An aerofoil sail has a rigid main panel (10) pivotally mounted to a hull (17) about a vertical axis (15) with trailing a flap (12A) hinged (14) to one side of the main panel. The trailing flap comprises a series of separate flaps (12A',12A'',12A''') individually settable so that the angle of incidence can differ ($\alpha,\beta$) at different levels on the sail. Alternatively, a single trailing flap can be torsionally flexible so that the angle of incidence can differ along its length. In a preferred form flaps (12A,12B) are provided at opposite edges of main panel (10) and can be alternatively folded in to give a reversible aerofoil section.

3 Claims, 7 Drawing Figures

AEROFOIL SAIL

Figure 1:
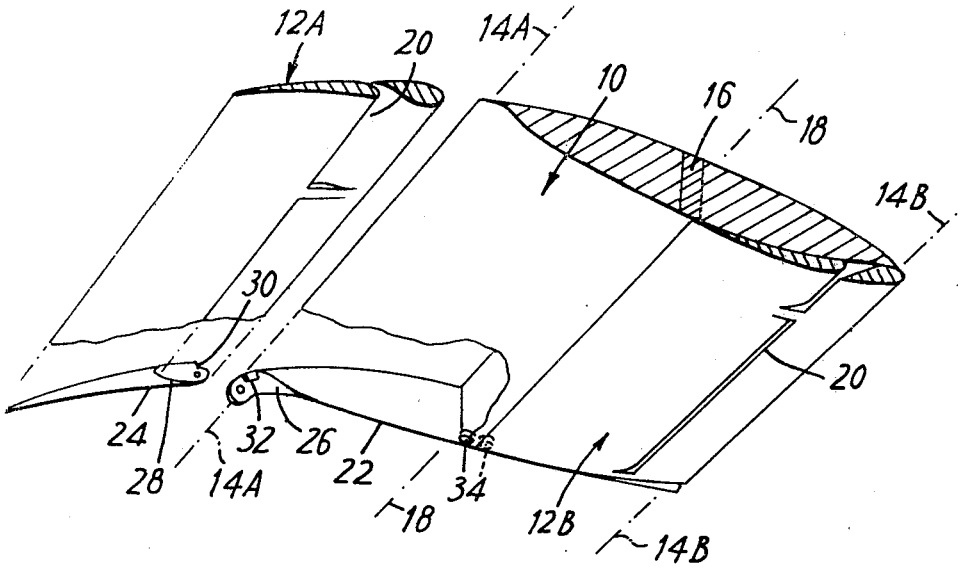

This invention relates to aerofoils, and is especially applicable to a rigid sail for sailing craft, including dinghies, yachts, land yachts, merchant vessels and other large ships whether wholly or partly wind propelled.

In my United Kingdom Patent Specification No. 1,410,175, I described an aerofoil, comprising a central panel and lateral panels hingedly connected at each side thereof, the central panel being arranged for rotation about a central longitudinal axis, the lateral panels on the two sides being of similar cross-section and the central panel being of symmetrical cross-section about a median plane passing through said central axis, the cross-sections of the panels being such that either one of the lateral panels could be folded inwardly to lie against the central panel or the other lateral panel or both, the combined panels thereby forming a non-symmetrical aerofoil in cross-section, the mirror image of which can be provided by alternatively folding in the other lateral panel, the aerofoil thus formed being adjustable relative to the prevailing air flow by rotation about said axis. Rigid sails with hinged trailing edge flaps, having constructions other than that described above, have also been known for some time.

One of the considerations in designing any rigid sail is that of selecting an appropriate sail plan which gives suitable efficiency and stability. Very often upwardly tapered or semi-elliptical shapes are employed, for reasons of improved stability and reduction of induced drag. The effect of these configurations is that the thrust produced by the upper part of the sail for a given wind speed tends to be appreciably less than that produced by the lower part of the sail. However, in light winds the speed of the air over the sea increases substantially with height, and as the "lift" thrust from an aerofoil goes up by the square of the wind speed it is possible for the top of a very tall sail to generate as much as four times the force produced at the base of the sail. Thus, in light air conditions a constant chord aerofoil could create twice the thrust as one with a heavily tapered sail plan of the same area. Since the efficiency of the sail under light air conditions is of considerable importance in establishing the viability of sail over other forms of power, a constant chord sail is to be preferred. Also, a constant section aerofoil has appreciable advantages in ease of construction and maintenance, and lower building costs.

The present invention provides an aerofoil sail comprising a rigid main panel and trailing flap means hinged to one side thereof, the trailing flap means being arranged so that its angle of incidence to the air flow can differ along the height of the sail to enable the flap means to adopt a lower angle of incidence at one end than at its other end.

The flap means may comprise a single flap which has a degree of torsional flexibility whereby different angles of incidence can be set at opposite ends. In another form, the flap means may comprise a plurality of individual flaps at different positions along the sail, and individually settable to different angles of incidence.

The angle of incidence may be determined by stops spaced lengthwise of the sail and limiting the hinging of the flap means in an extended condition. In the case of a torsionally flexible flap the stop at one end of the sail can be initially engageable when the flap moves into the extended condition, the remaining stops being engageable as a result of further pressure, e.g. wind pressure or pressure applied by an operator, on the flap causing the flap to twist.

The upper end of the sail will normally have the lesser angle of incidence for the flap than the lower end. The sail is suitably of uniform chord, and preferably of uniform cross-section throughout its height.

The aerofoil is preferably of the type described above in relation to my United Kingdom Pat. No. 1,410,175, both of said lateral panels (i.e. alternative trailing edge flaps) having torsional flexibility and angle setting means as defined above.

Figure 2:
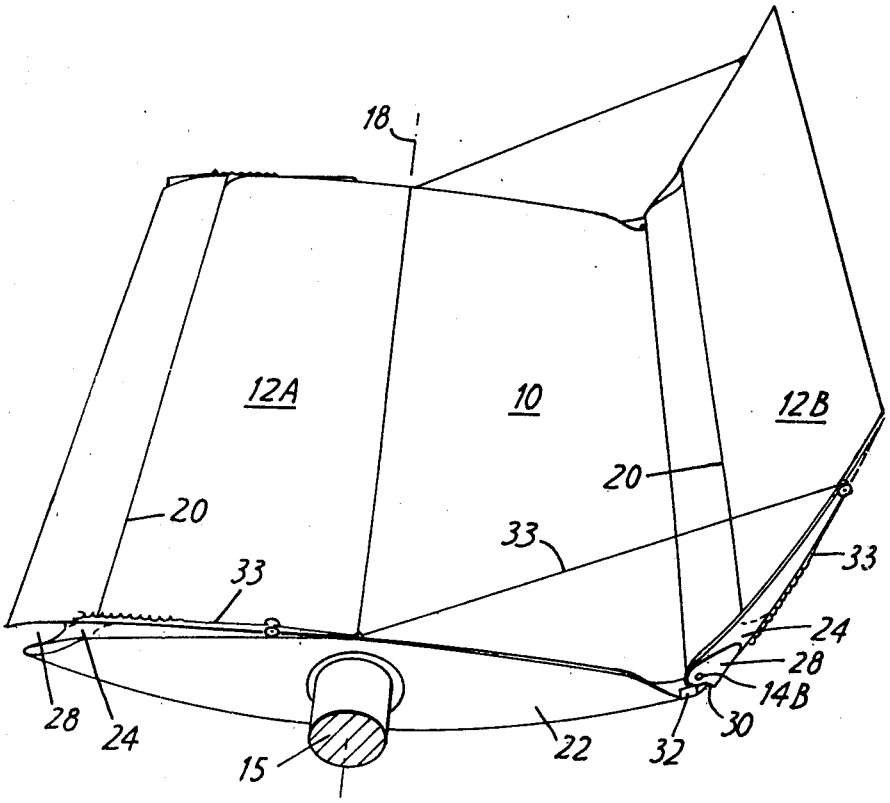
Figure 3:
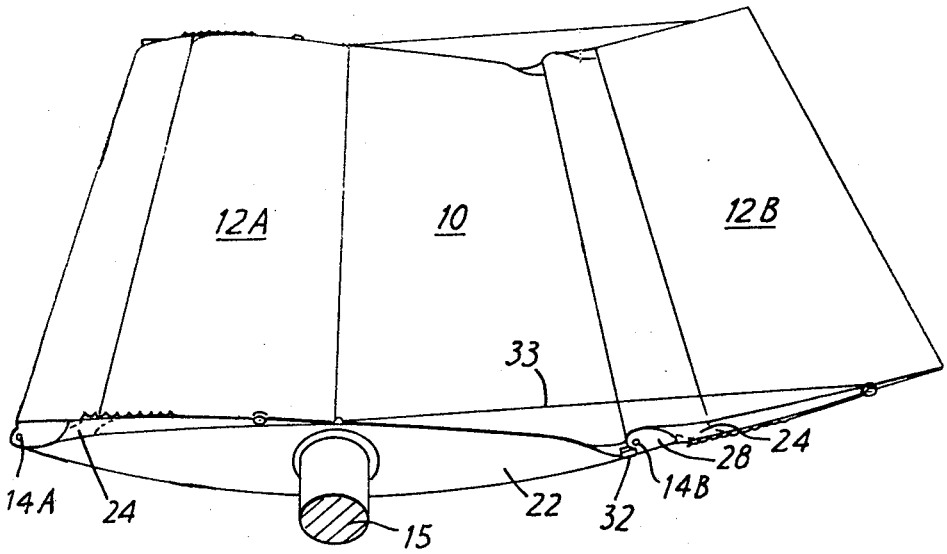
Figure 4:
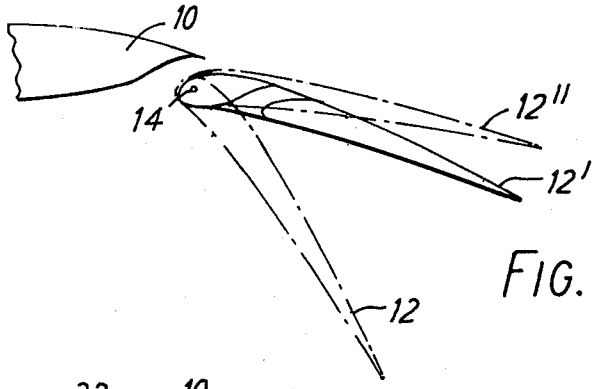
Figure 5:
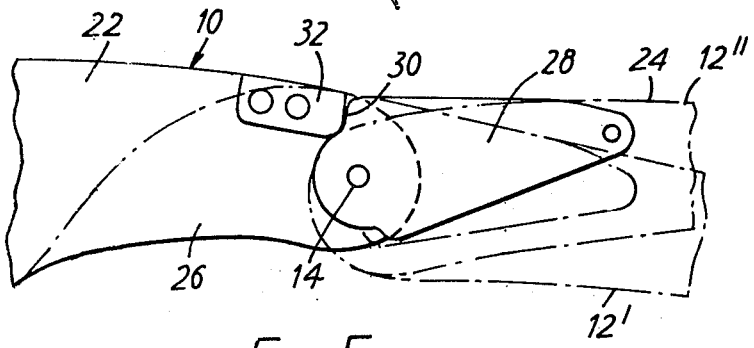
Figure 6:
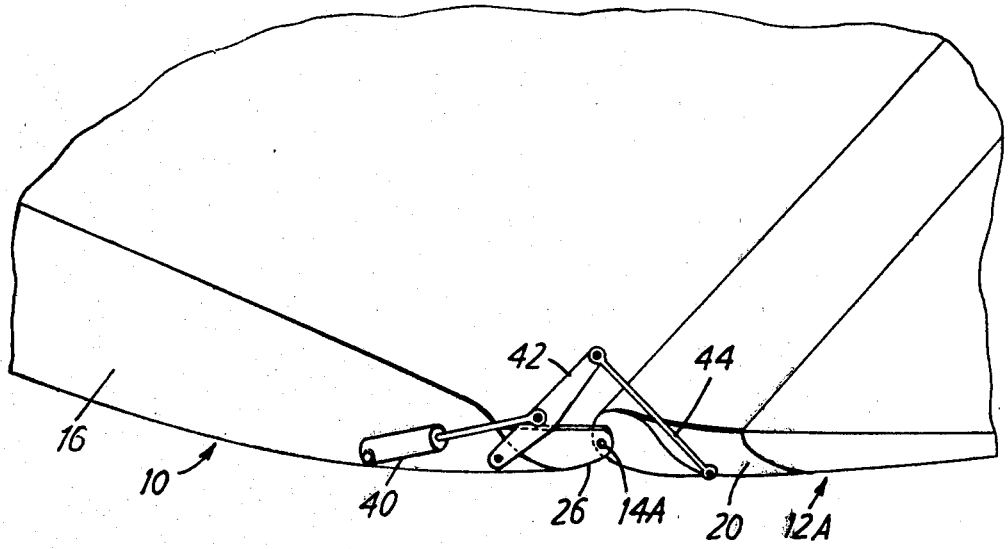
Figure 7:
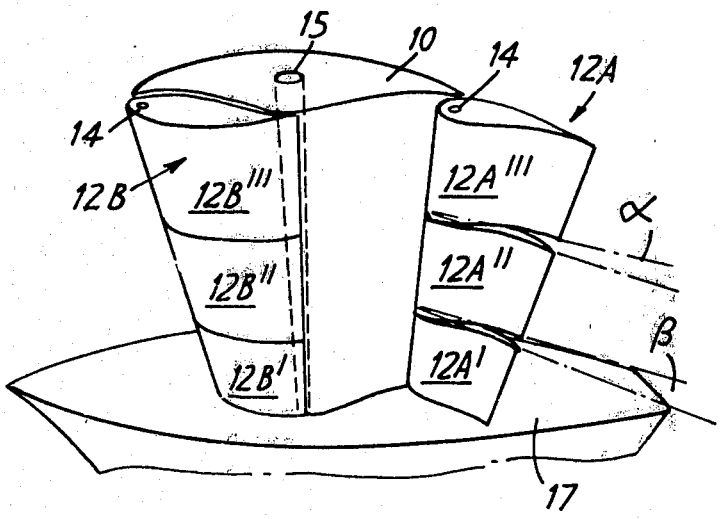

In order that the invention may be more clearly understood, one embodiment will now be described with reference to the accompanying drawings, wherein:

FIG. 1 shows a perspective, partly cut-away, partly exploded view of an aerofoil sail, FIGS. 2 and 3 show perspective views of (a relatively short length of) the assembled aerofoil at two flap angles, FIG. 4 shows diagrammatically the trailing edge section of the sail with the trailing edge flap at different angles of incidence, FIG. 5 shows a detail of the flap mounting and stop arrangement, FIG. 6 shows diagrammatically part of a sail with hydraulic operation, and FIG. 7 shows a perspective view from above of an aerofoil sail on a sailing craft.

Referring to the drawings and firstly to FIGS. 1 to 3; the aerofoil sail comprises a central panel 10 and lateral flaps 12 (A and B) hingedly connected at each side of the central panel for hinging above respective axes 14 (A and B). (In FIG. 1 the flap 12A is shown detached from the main panel). The central panel has a central longitudinal spar 16 which, when the sail is fitted to a sailing craft, is journalled, for example on shaft 15 shown in FIGS. 2 and 3, to the body of the craft for rotation above a longitudinal central axis 18. The central panel is of symmetrical cross-section about a median plane passing through the central axis 18. The lateral flaps are of similar cross-section to each other, and are designed in conjunction with the cross-section of the central panel so that either one of the lateral panels can be folded inwardly to lie against the central panel, with the other flap extended, thereby forming a non-symmetrical aerofoil, as shown in FIG. 1, where the flap 12B is folded inwards to lie against the central panel and the flap 12A is extended. By folding the flap 12A inwards to lie against the central panel and extending the flap 12B, the mirror image aerofoil section is produced, as shown in FIGS. 2 and 3. In the embodiment shown in FIGS. 1 to 3, the flaps are provided with slots 20 for improved aerodynamic performance, but they need not necessarily be slotted. The extended flap can be hinged into varying angles of incidence, according to the prevailing wind conditions and degree of lift required. FIG. 2 shows the flap (also shown at 12 in FIG. 4) at about 65° to the plane of the main panel, thereby providing a high lift aerofoil section useful in light wind conditions. In FIG. 3 (and in position 12' in FIG. 4) the flap is shown in a fully extended condition, at which it is about 20° to the plane of the main panel. Such a condition is suitable for higher wind speed conditions. The flap may be settable at any desired position up to position 12', according to the degree of lift required, or it may have just certain discrete positions in which it can be set. The flap has however some longitudinal torsional flexibility, and its connection with the main panel enables the angle of incidence of the flap in the fully extended condition to be reduced up the sail. Thus, with reference to FIG. 4, if position 12′ represents the flap in its fully extended condition at the base of the sail, by applying longitudinal twisting of the flap, at the top of the sail it may assume position 12″, for example at an angle of about 10° to the plane of the main panel (i.e. about 10° less than its angle of incidence at the base of the sail). The effect of this is to reduce the lift produced by the aerofoil up the sail. The flap need not automatically go into the twisted condition when it is fully extended. Initially, when fully extended, the flap may be at position 12′ throughout its length. Twisting of the flap can then be applied when and to the extent necessary.

A suitable method of mounting the flap to the main panel to allow this twisting feature is shown in FIGS. 1 to 3, and in more detail in FIG. 5. The main panel and the flaps are provided with ribs 22,24 respectively at their ends, and optionally at one or more intermediate positions also. The ribs 22 of the main panel are provided with projecting portions 26 which are apertured to provide the hinge on the axis 14. Each rib 24 of the flaps has secured on either side of it a pair of plates 28 which between them rotatably receive the projecting portion 26 of a main panel rib 22 and are apertured in register with the aperture in the projecting portion 26 to accommodate the hinge. Each plate 28 is also formed with a shoulder 30 which, when the flap is swung out as far as it will go, abuts the edge of a respective one of a pair of stop plates 32 secured on either side of the main panel rib 22. By cutting back the shoulders 30 or the co-operating edge of the stop plates 32 on the ribs located higher up the sail, the stop becomes effective at progressively smaller angles of flap incidence up the sail.

The movement of the flaps relative to the main panel can be effected by any suitable means, for example by hydraulic cylinders or the like, but in this embodiment it is effected by means of cables, for example as shown at 33 in FIGS. 2 and 3, extending from the flaps to the main panel, and trained around suitably located pulleys, for example the pulleys 34 shown in FIG. 1, for operation at the level of the hull. The controlling cables coming from the flap at different levels can be operated together under most conditions, but when it is required to introduce twisting of the flap, the cables can all be pulled tight independently so that at all positions the flap is pulled against the stops 32. The effect of the twisting of the extended flap is, as noted, to reduce the lift produced higher up the sail. This has an effect equivalent to that of a tapered or semi-elliptical aerofoil at shallow angles of incidence to the wind. Under light wind conditions the sail can be set into its high lift configuration, with extended flap at about 65° (position 12). Under somewhat higher wind conditions, the high lift configuration is not needed, so the extended flap is moved to its normal low lift, low drag configuration (position 12′). However, to improve the stability of the craft and reduce the induced drag, the extended flap can be moved into its twisted configuration so that the upper part assumes position 12″. This has the effect of lowering the centre of pressure of wind on the aerofoil. With increasing wind speed, the angle of incidence of the aerofoil has to be continually reduced, and the relative aerofoil lift force reduced further in the higher regions of the aerofoil, thus further lowering the centre of pressure and giving an inherent stability to the rig. At length, a point can be reached, at a very shallow angle of incidence at the base of the aerofoil, at which the top of the aerofoil starts giving negative lift (i.e. in the direction opposite to that at the bottom of the aerofoil), so that it should be possible to make the rig essentially non-overturning. As the extended flap is held rigid against its stops, it is possible to exercise a precise control over the thrust provided by the sail, even in hurricane force winds.

FIG. 6 shows an arrangement in which the hinging of the lateral flaps 12 is effected by means of a series of hydraulic cylinders 40 (only one is shown in FIG. 6) spaced at intervals along the length of the sail and operating between the central panel 10 and each of the lateral panels 12A,12B through respective levers 42 and connecting rods 44. The sail can be provided with variably located stops for the lateral panels when extended, as described above, or the variable angle of extension can be accomplished by varying the extension of the hydraulic cylinders 40 at different positions up the sail.

Referring to FIG. 7; the central panel 10 is shown journalled on a mast 15, the lower end of which is mounted on the hull 17 of a sailing craft. (Although only one sail is shown, the craft may have two or more such aerofoil sails). Each of the lateral panels 12A,12B is made up from a number of identical sections 12A′,-12A″,12A‴ etc., arranged end-to-end, pivoted about the same axis 14, but independently settable. Thus, as shown in the drawing, the angle of incidence of the extended lateral panel can vary from the top to the bottom of the sail, with the panel section 12A‴ at the top of the sail having the least angle of incidence, and the panel sections 12A″ and 12A′ etc. having progressively greater angles of incidence as indicated at $\alpha$ and $\beta$. Since the panel sections are independently settable, they can alternatively be set to have the same angle of incidence, or the change of angle of incidence can be reversed so that the lateral panel has the highest angle of incidence at the top.

This latter feature may be particularly useful under low wind speed conditions. Thus, a range of settings can be produced, varying from that in which the upper part of the sail has a higher angle of incidence, through the position in which there is a constant angle of incidence, leading to a condition in which the upper part of the sail has a lower angle of incidence.

The actual settings of the lateral panel and sections thereof, together with the operation of the sail generally, can be controlled by computer, based upon the prevailing weather conditions and other criteria.

This arrangement of FIG. 7 also gives a great deal more flexibility in construction and operation, and enables the individual lateral panel sections to be substantially rigidly constructed. Moreover, individual lateral panel sections can be taken out of use by folding them inwardly over the central main panel, for example if their operating mechanism becomes defective or if the prevailing wind conditions indicate that they should not be used.

I claim:

1. An aerofoil sail comprising a rigid main panel and an essentially rigid flap hinged to one side thereof, the trailing flap having a degree of torsional flexibility whereby it can twist to provide different angles of incidence at opposite ends thereof, a plurality of stop means being along the edge of the flap provided to limit the hinging of the flap in an extended condition, the stop means at the lower end of the sail being initially engageable when the flap moves into extended condition, the remaining stop means being engageable as a result of further pressure on the flap causing the flap to twist, so that the angle of incidence to the air flow can be lower at the top of the sail than at the bottom of the sail.

2. An aerofoil sail according to claim 1 wherein the sail is of uniform chord and cross-section throughout its height.

3. An aerofoil sail according to claim 1 wherein the central panel has a said trailing flap hinged to each side thereof, the trailing flap on the two sides being of similar cross-section and the central panel being of symmetrical cross-section about a longitudinal median plane transverse to that of the panel, the cross-sections of the flap being such that either one of them can be folded inwardly to lie against the central panel or the other trailing flap or both, the combined central panel and flap thereby forming a non-symmetrical aerofoil in cross-section, the mirror image of which can be provided by alternatively folding in the other trailing flap.

* * * * *